US007448906B1

(12) United States Patent
Islam

(10) Patent No.: US 7,448,906 B1
(45) Date of Patent: Nov. 11, 2008

(54) HOLLOW INNER CONDUCTOR CONTACT FOR COAXIAL CABLE CONNECTOR

(75) Inventor: Nahid Islam, Westmont, IL (US)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 11/843,599

(22) Filed: Aug. 22, 2007

(51) Int. Cl.
*H01R 9/05* (2006.01)

(52) U.S. Cl. ..... 439/578

(58) Field of Classification Search ..... 439/578–585
See application file for complete search history.

(56) References Cited

U.S. PATENT DOCUMENTS

| | | | | |
|---|---|---|---|---|
| 3,106,599 | A | 10/1963 | Leitner et al. | |
| 5,137,470 | A | 8/1992 | Doles | |
| 5,545,059 | A | 8/1996 | Nelson | |
| 5,722,856 | A | 3/1998 | Fuchs et al. | |
| 5,830,009 | A * | 11/1998 | Tettinger | 439/578 |
| 6,133,532 | A | 10/2000 | Lundback et al. | |
| 6,148,513 | A | 11/2000 | Schiefer et al. | |
| 6,332,808 | B1 | 12/2001 | Kanda et al. | |
| 6,692,300 | B2 | 2/2004 | Kanda et al. | |
| 6,802,739 | B2 | 10/2004 | Henningsen | |
| 6,863,565 | B1 | 3/2005 | Kogan et al. | |
| 6,893,290 | B2 * | 5/2005 | Buenz et al. | 439/578 |
| 6,926,555 | B2 | 8/2005 | Nelson | |
| 2007/0149047 | A1 * | 6/2007 | Wild et al. | 439/578 |

* cited by examiner

*Primary Examiner*—James Harvey
(74) *Attorney, Agent, or Firm*—Babcock IP, PLLC

(57) ABSTRACT

A coaxial cable connector inner contact with an interface end and a cable end for a coaxial cable with a hollow inner conductor having an outer diameter surface and an inner diameter surface. The inner contact having an inner conductor interface at the interface end and a spring contact proximate the cable end dimensioned to engage the outer diameter surface. A plug hole open to the cable end retains a plug, the plug dimensioned to insert into the hollow inner conductor and seat against the inner diameter surface.

20 Claims, 7 Drawing Sheets

HOLLOW INNER CONDUCTOR CONTACT FOR COAXIAL CABLE CONNECTOR

BACKGROUND OF THE INVENTION

1. Field of the Invention

The invention relates to inner contacts for coaxial cable connectors. More particularly the invention relates to coaxial cable connector inner contacts with improved inter modulation distortion (IMD) performance and or compatibility with hollow aluminum or bi-metal inner conductors.

2. Description of Related Art

IMD performance may be degraded when a less than optimal electrical connection is made between the inner contact and the inner conductor. An inner conductor contact may be skewed during installation, for example, because the inner conductor may be movable relative to the outer conductor due to the elasticity of the surrounding foam insulation.

Prior connections to hollow inner conductor coaxial cables have applied various plug type inner contact connections inserted into the open end of the hollow inner conductor to create an electrical connection between the inner diameter surface of the hollow inner conductor and the plug. These connections may be mechanically complex and or difficult to reliably seal against moisture penetration into the hollow inner conductor.

Competition within the coaxial cable and connector industry has focused attention upon improving electrical performance as well as reducing manufacturing, materials and installation costs.

Therefore, it is an object of the invention to provide a method and apparatus that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Although coaxial cables typically have inner and outer conductors made from copper and copper alloy, the inventor has recognized that new coaxial cable configurations having a hollow aluminum and or aluminum with copper or other metallic outer coating inner conductor would reduce materials cost and overall cable weight. These new coaxial cable configurations are generally incompatible with prior coaxial connectors due to a creep characteristic of these softer metals and the difficulty of forming a reliable electrical connection between dissimilar metals subject to galvanic corrosion and or moisture accelerated oxidation.

The creep and stress relaxation characteristics of softer metals, such as aluminum alloys, make these materials an especially poor choice for hollow inner conductor inner diameter surface spring or mechanical wedge electrical inter-connections with the inner contact. The creep characteristic of the softer metals leads to an inward and or outward flow of the inner conductor sidewall material immediately away from a spring bias applied by connection elements of the connector, degrading the quality of the electrical connection and or environmental sealing of the connection over time. Further the aluminum alloys generally have poor strength characteristics that increases the opportunity for inner conductor deformation during connector attachment, increasing the possibility of a less than uniform electrical connection with increased inter-modulation distortion (IMD).

Galvanic corrosion between the aluminum and a dissimilar metal of the inner contact such as brass or copper may also contribute to degradation of the electrical and mechanical interconnection. Further, moisture penetration into the hollow inner conductor is a much greater problem with aluminum compared to copper material, because of the increased chance for corrosion of the aluminum material and or delamination of the outer diameter surface copper coating.

Figure 1:
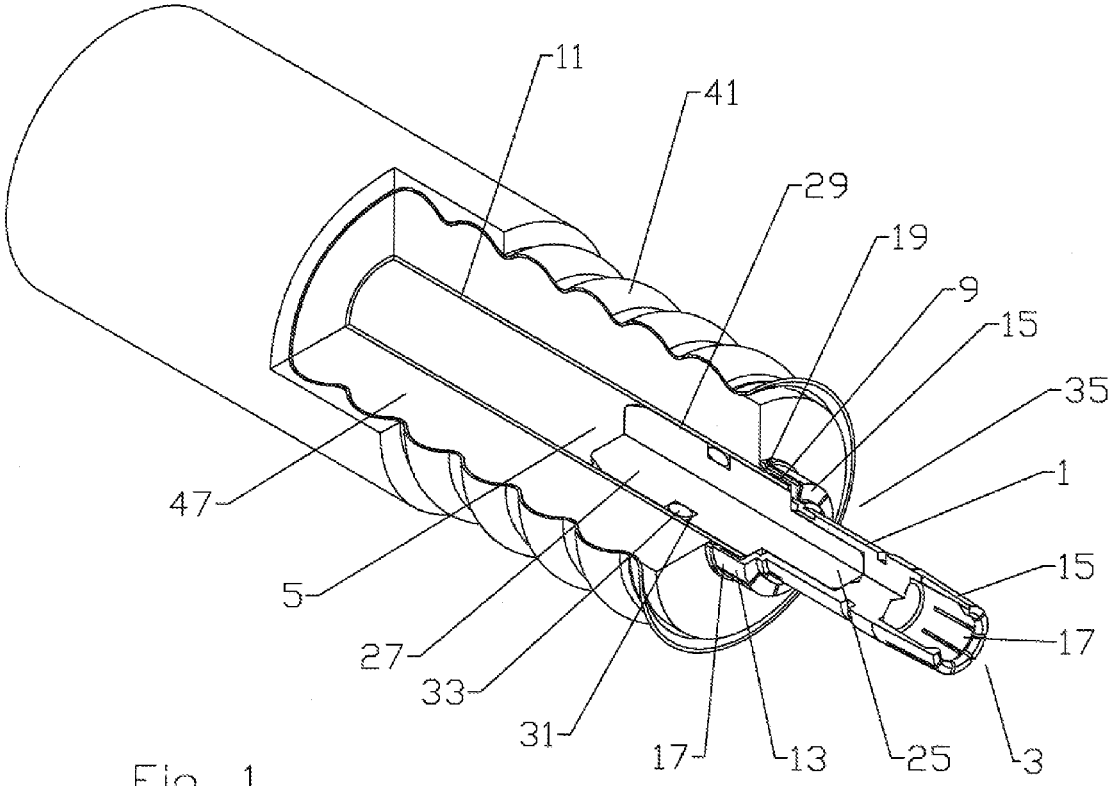
FIG. 1 is a schematic partial 45 degree cut-away isometric view of a first exemplary embodiment of an inner conductor contact connected to a coaxial cable.
Figure 2:
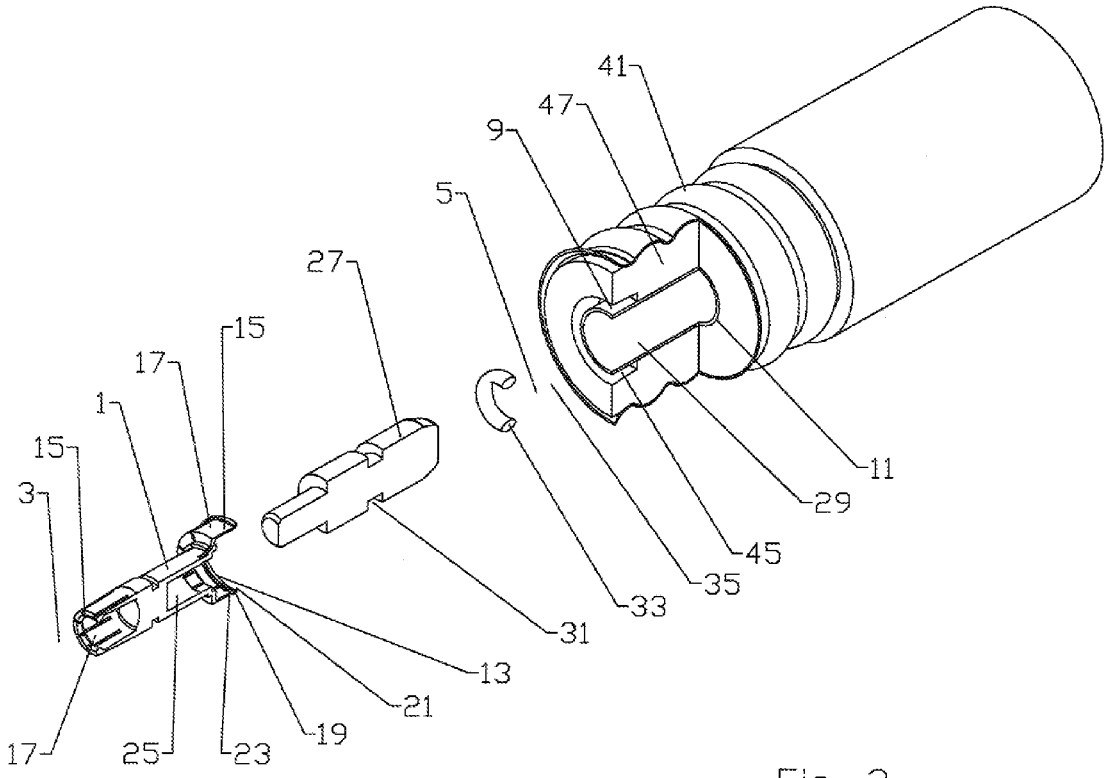
FIG. 2 is a schematic partial cross sectional exploded isometric view of the first exemplary embodiment of an inner conductor contact and coaxial cable.
Figure 3:
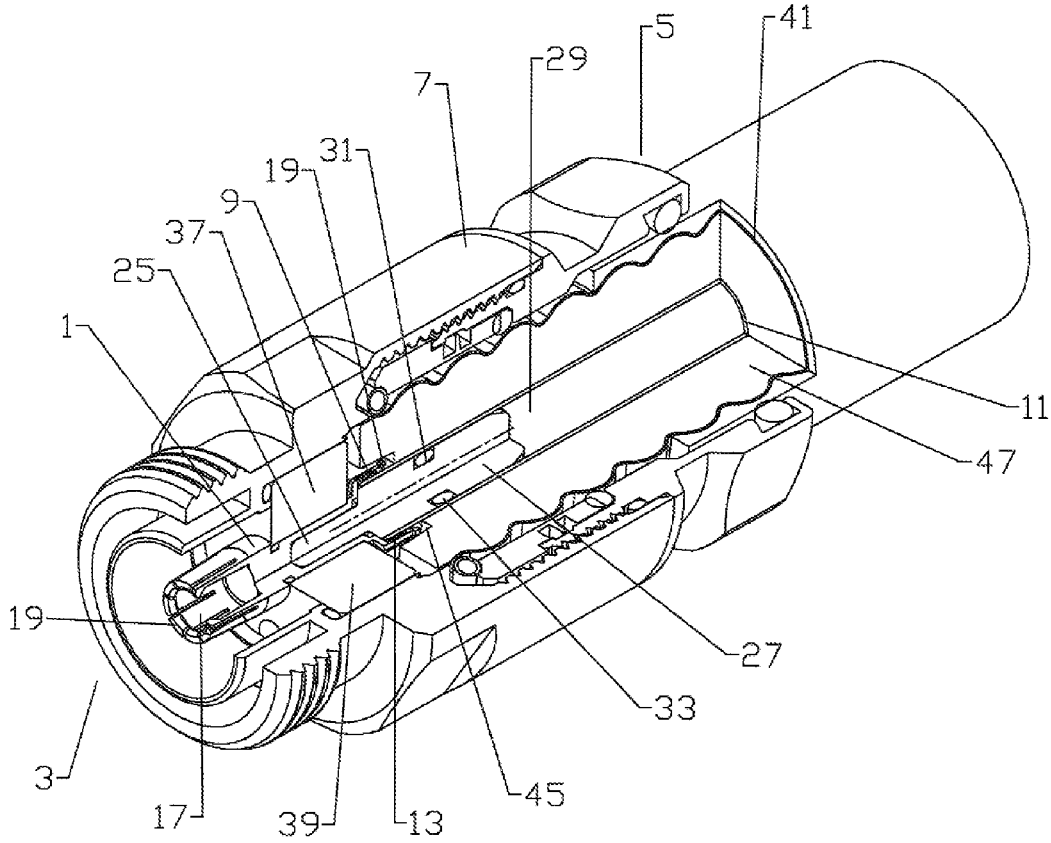
FIG. 3 is a schematic partial 90 degree cut-away isometric view of a first exemplary embodiment of an inner conductor contact and an exemplary outer conductor connecting connector and interface installed upon a coaxial cable.

As shown in FIGS. 1-3, a first embodiment of a coaxial cable connector inner contact 1 with an interface end 3 and a cable end 5 (end designations along the inner contact longitudinal axis that are hereinafter similarly applied to individual elements of the inner contact 1 and associated connector assembly 7) attaches to the outer diameter surface 9 of the hollow inner conductor 11 via a spring contact 13 proximate the cable end 5 dimensioned to engage the outer diameter surface 9 of the inner conductor 11. The spring contact 13 is here demonstrated formed as a spring basket 15 that surrounds the inner conductor 11 with a plurality of inward biased spring finger(s) 17 formed integral with cable end 5 of the inner contact 1. The spring finger(s) 17 may be formed with an inward projection 19 proximate the cable end 5 having an angled edge 21 facing the cable end 5 for easy insertion over the inner conductor 11 outer diameter surface 9, and a corner edge 23 at the interface end 3 operative as a barb to inhibit removal after insertion over the inner conductor 11 outer diameter surface 9.

A plug hole 25 open to the cable end 5 is dimensioned to receive and retain the interface end 3 of a plug 27 dimensioned to insert into the hollow inner conductor 11 and seat against the inner diameter surface 29. The plug 27 is operative as an insertion guide during application of the inner contact 1, an environmental seal and as a supporting surface for the hollow inner conductor 11 against the inward bias of the spring contact 13 against the outer diameter surface 9. Where electrical contact only along the outer diameter surface 9 of the hollow inner conductor 11 is desired, the plug 27 may be cost effectively formed from a non-metallic material such as a dielectric polymer, for example polytetrafluoroethylene, polyethylene, polycarbonate or other suitable plastic material.

To improve the environmental seal with respect to the hollow inner conductor 11, the plug 27 may be formed with a seal seating feature, such as an outer diameter groove 31 in which a seal 33 such as an o-ring gasket or the like may be seated, for example proximate the cable end 5 of the plug 27, to environmentally seal between the plug 27 and the inner diameter surface 29 of the inner conductor 11. The interface end 3 of the inner contact 1 is demonstrated in FIGS. 1-3 as a spring basket 15, according to the connector industry standard 7/16 DIN female connector interface. Alternatively, the interface end 3 may be a pin or other desired inner conductor interface and or interconnection surface according to any desired standard or proprietary coaxial connector interface, including for example, a threaded connection surface to which a further interface element may be attached.

FIGS. 1-3 also demonstrate alternative coaxial cable connection end 35 configurations for attaching the inner contact 1 and a further connector assembly 7 that carries the inner contact 1 supported coaxial within a bore 37 by an insulator 39, the connector assembly 7 coupling with an outer conductor 41 of the coaxial cable 43. FIG. 1 demonstrates the inner contact 1 configured to couple with the inner conductor 11 projecting forward of the outer conductor 41 and FIGS. 2 and 3 demonstrate the inner contact 1 and the supporting connector assembly 7 configured to couple with the inner conductor 11 flush with the outer conductor 41. In the flush configuration, to provide a clear area 45 for insertion of the spring contact 13 over the outer diameter surface 9 of the inner conductor 11, the mating area of coaxial cable insulation 47 is removed before assembly, for example as shown in FIG. 2. The connector assembly 7 configuration is dependent upon the outer conductor 41 configuration and or desired connection interface of which a wide range of configurations are well known to one skilled in the art and as such are not further described herein.

Figure 4:
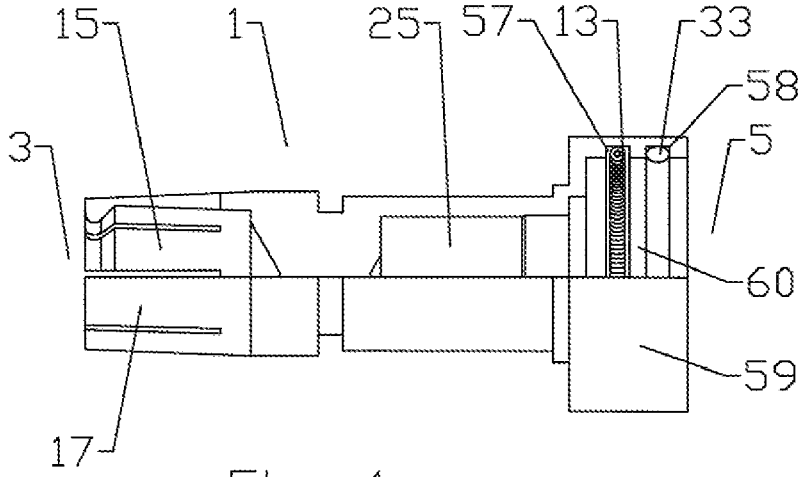
FIG. 4 is a schematic partial cut-away view of an alternative inner conductor contact.
Figure 5:
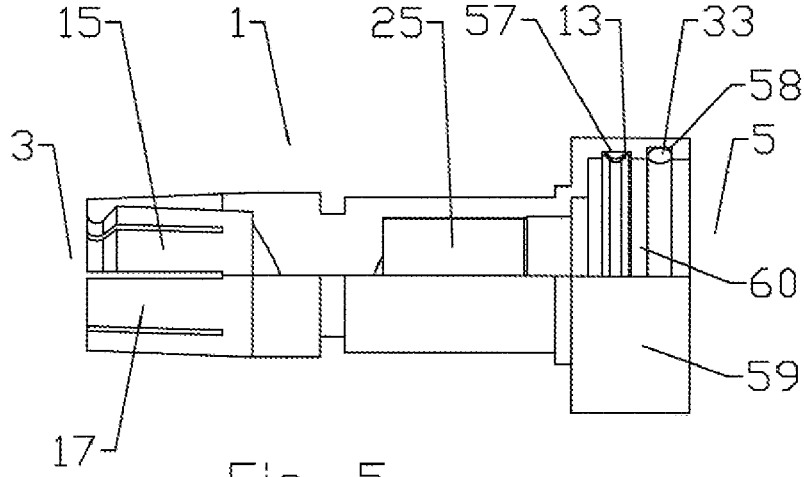
FIG. 5 is a schematic partial cut-away view of an alternative inner conductor contact.
Figure 6:
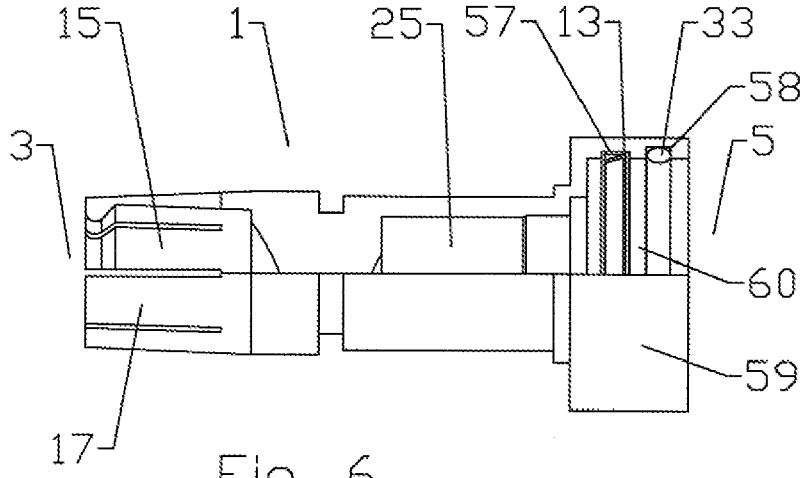
FIG. 6 is a schematic partial cut-away view of an alternative inner conductor contact.

The spring contact 13 may be configured in a wide range of alternative configurations. For example, as shown in FIG. 4, the spring contact 13 may also be formed as at least one spring coil 55 retained within a first inner diameter groove 57 of an overlapping surface 59 of the inner contact 1. Additional inner contact 1 to inner conductor 11 environmental sealing may be added by including an inward projecting seal 33 retained, for example in a second inner diameter groove 58 around the overlapping surface 59 inner diameter 60, preferably proximate the cable end 5. Alternative spring contact 13 configurations include, for example, a generally U-shaped spring (FIG. 5) and a side mounted v-shaped spring (FIG. 6).

Figure 7:
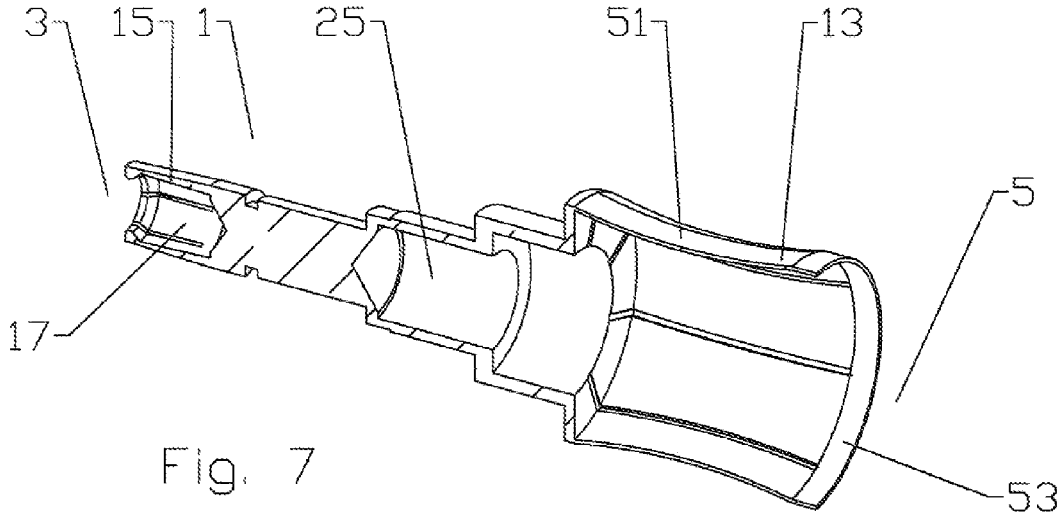
FIG. 7 is a schematic partial 90 degree cut-away isometric view of an alternative inner conductor contact.
Figure 8:
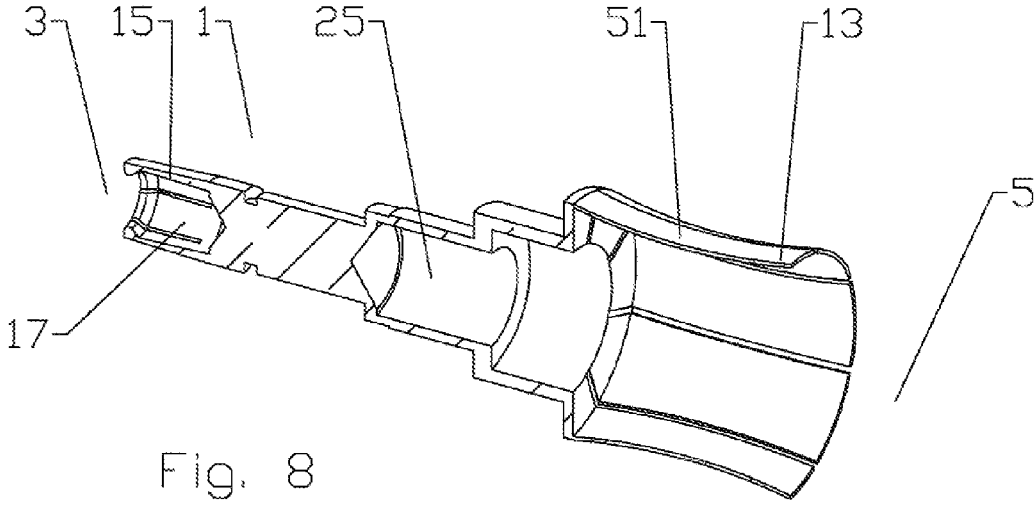
FIG. 8 is a schematic partial 90 degree cut-away isometric view of an alternative inner conductor contact.

Another embodiment of the spring contact appears in FIGS. 7 and 8. The spring contact may be formed as an inward bend 51 of each spring finger 17 with a maximum inward projection proximate a longitudinal mid point of the spring contact 13, the cable end 5 of the spring finger(s) 17 each joined by a reinforcing ring 53 (FIG. 7), or allowed to move independently (FIG. 8).

Figure 9:
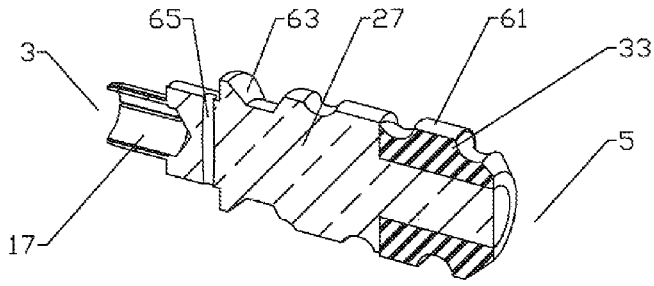
FIG. 9 is a schematic cross sectional isometric view of an alternative plug. is a schematic isometric view of an alternative inner contact and plug.
Figure 10:
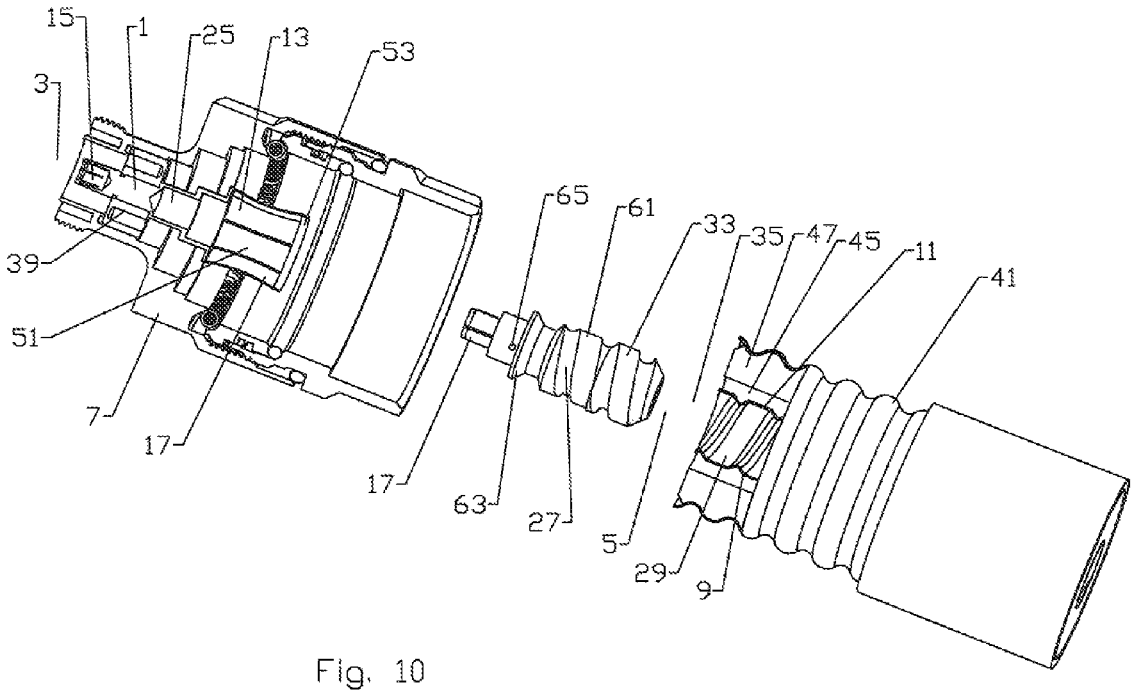
FIG. 10 is a schematic partial cross sectional isometric view of an alternative embodiment of an inner conductor contact, plug and an exemplary outer conductor connecting connector and interface.

The coaxial cable inner conductor 11 may be helically corrugated. The plug 27, for example as shown in FIGS. 9 and 10, may be configured with corresponding threads 61 threadable into the helical corrugations, to similarly provide support for the corrugated outer diameter surface 9 of the hollow inner conductor 11. The threaded plug 27 may have a seal 33 in the form of a threaded gasket portion formed with outer diameter threads 61, preferably proximate the cable end 5 of the plug. FIGS. 6 and 7 also demonstrate a plug 27 shoulder 63 formed proximate the interface end 3 against which the connection end 35 of the hollow inner conductor 11 will abut when the plug 27 is fully seated (threaded) into the hollow inner conductor 11. Where the inner conductor 11 has a bi-metal configuration, for example a copper outer coating upon the outer diameter surface 9 of a hollow aluminum inner conductor 11, the shoulder 63, if formed on a plug 27 of dielectric material, prevents any electrical contact with the exposed aluminum connection end 35 of the inner conductor 11. Thereby, the possibility of a dissimilar metal electrical connection between the inner contact 1 and the inner conductor 11 is eliminated.

To simplify assembly where a threaded plug 27 is used, the plug 27 may be applied to the inner conductor 11, threaded into place, for example via flat(s), a tool depression or hole 65 formed in or proximate the shoulder 63, before the plug 27 is coupled to the inner contact 1. As shown for example in FIG. 7, the interface end 3 of the plug 27 may be formed with outward biased spring finger(s) 17 that mate with the plug hole 25 as the connector assembly 7, including the inner contact 1 is applied to the connection end 35 of the coaxial cable.

Figure 11:
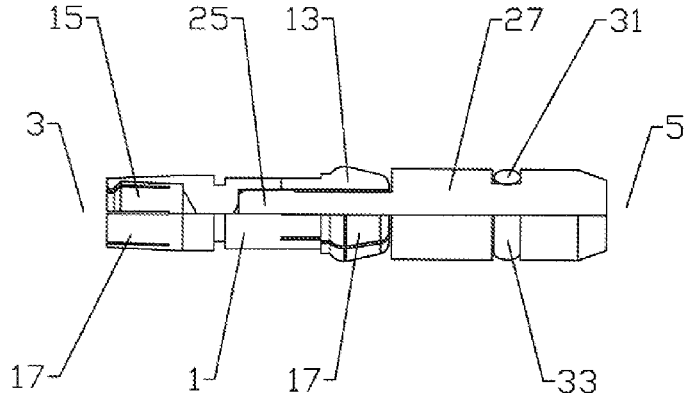
FIG. 11 is a schematic partial 90 degree cut-away view of an alternative inner conductor contact and plug.
Figure 12:
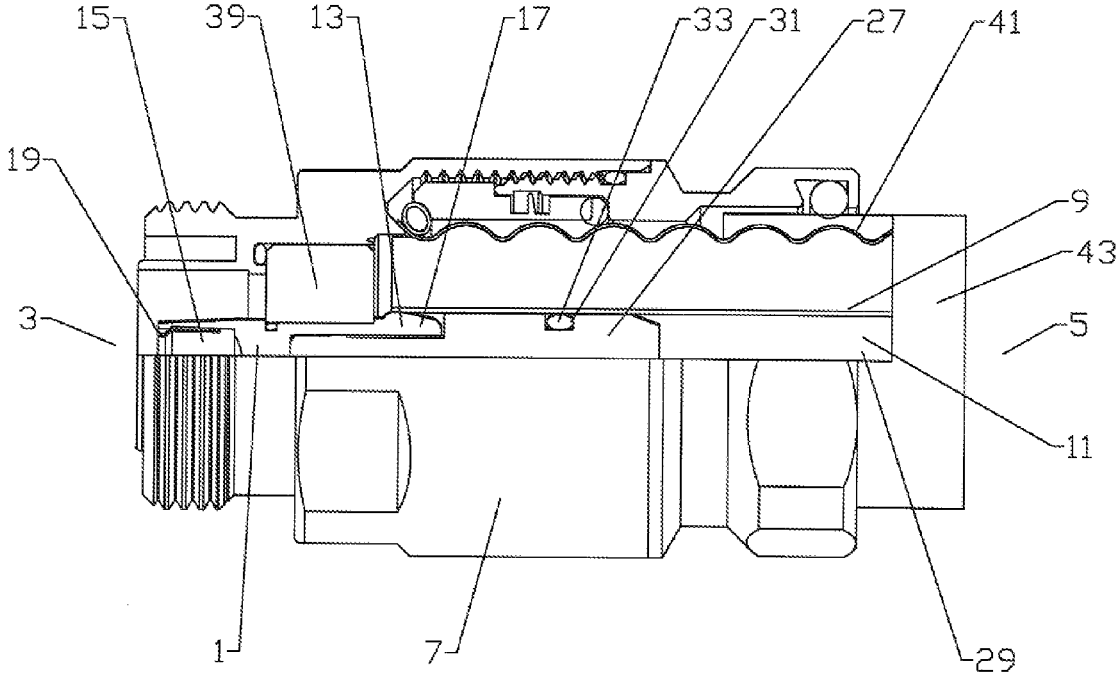
FIG. 12 is a schematic partial 90 degree cut-away view of an alternative embodiment of an inner conductor contact, plug and an exemplary outer conductor connecting connector and interface.

Further, the plug 27 is useful as an assembly guide and environmental seal, even where a conventional inner diameter surface 29 contacting spring contact or the like is applied to the inner contact 1 as shown for example in FIGS. 11 and 12, correcting any initial deformation that may have occurred during cable connection end 35 preparation and minimizing the opportunity for deformation or misalignment of the inner conductor 11 during connector assembly that could lead to poor connection quality and increased IMD.

One skilled in the art will appreciate that the outer diameter surface 9 connection of the spring contact 13, supported by the plug 27 inserted within the hollow inner conductor 11 enables secure electrical connection between the inner conductor 11 and the inner contact 1 with reduced risk of electrical failure due to the inherent creep and stress deformation material characteristics of aluminum alloys. The inner contact 1 is especially suited for a coaxial cable with a hollow aluminum inner conductor 11 having a copper coating about the outer diameter surface 9, thereby enabling secure electrical contact without the disadvantages of direct contact electrical connections between dissimilar metals and or aluminum oxidation while availing of the lower material cost and weight of a hollow aluminum inner conductor 11 coaxial cable. Similarly, the invention is operable via bi-metal arrangements of the spring contact 13, including for example, tin or silver coatings.

Finally, the inner contact 1 may be incorporated into a wide range of existing coaxial connector assemblies 7 with a minimum of re-engineering and or tooling.

| Table of Parts | |
|---|---|
| 1 | inner contact |
| 3 | interface end |
| 5 | cable end |
| 7 | connector assembly |
| 9 | outer diameter surface |
| 11 | inner conductor |
| 13 | spring contact |
| 15 | spring basket |
| 17 | spring finger |
| 19 | inward projection |
| 21 | angled edge |
| 23 | corner edge |
| 25 | plug hole |
| 27 | plug |
| 29 | inner diameter surface |
| 31 | outer diameter groove |
| 33 | seal |
| 35 | connection end |
| 37 | bore |
| 39 | insulator |
| 41 | outer conductor |
| 43 | coaxial cable |
| 45 | clear area |
| 47 | insulation |
| 51 | inward bend |
| 53 | ring |
| 55 | spring coil |
| 57 | first inner diameter groove |
| 58 | second inner diameter groove |
| 59 | overlapping surface |
| 60 | inner diameter |
| 61 | thread |
| 63 | shoulder |
| 65 | hole |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. An coaxial cable connector inner contact with an interface end and a cable end for a coaxial cable with a hollow inner conductor having an outer diameter surface and an inner diameter surface, comprising:

an inner conductor interface at the interface end;

a spring contact proximate the cable end dimensioned to engage the outer diameter surface;

a plug hole open to the cable end; and a plug retained within the plug hole; the plug dimensioned to insert into the hollow inner conductor and seat against the inner diameter surface.

2. The inner contact of claim 1, wherein the plug is non-metallic.

3. The inner contact of claim 1, wherein the plug is threaded to mate with helical corrugations of the inner conductor.

4. The inner contact of claim 1, wherein the plug has an outer diameter groove for a seal; the seal sealing between the inner diameter and the plug.

5. The inner contact of claim 1, wherein a seal seated proximate the cable end of the plug seals between the plug and the inner diameter.

6. The inner contact of claim 1, wherein the spring contact has an inward projecting contact surface proximate the cable end.

7. The inner contact of claim 1, wherein the spring contact has an inward projecting contact surface formed as an inward curved bend of each spring finger.

8. The inner contact of claim 1, wherein the spring contact has an inward projecting contact surface proximate a midpoint of the spring contact.

9. The inner contact of claim 8, wherein the cable end of the spring contact is retained by a reinforcing ring.

10. The inner contact of claim 1, wherein the spring contact is at least one spring coil retained within a first inner diameter groove of an inner diameter of an overlapping surface.

11. The inner contact of claim 10, further including an inward projecting sealing gasket retained about the inner diameter of the overlapping surface, proximate the cable end.

12. The inner contact of claim 1, wherein the inner conductor interface is a spring basket.

13. The inner contact of claim 1, wherein the inner conductor interface is a pin.

14. The inner contact of claim 1, wherein an outer diameter shoulder of the plug is dimensioned to seat against an open end of the hollow inner conductor, such that the inner contact has electrical contact only with the outer diameter of the inner conductor.

15. The inner contact of claim 1, further including an insulator and a connector body assembly; the insulator retaining the inner contact coaxial within a bore of the connector body assembly, the connector body assembly coupling with an outer conductor of the coaxial cable.

16. The inner contact of claim 15, wherein the inner contact couples with the inner conductor projecting forward of the outer conductor.

17. The inner contact of claim 15, wherein the inner contact couples with the inner conductor projecting flush with the outer conductor.

18. An coaxial cable connector inner contact with an interface end and a cable end for a coaxial cable with a hollow inner conductor having an outer diameter surface and an inner diameter surface, comprising:

an inner conductor interface at the interface end;

a spring contact proximate the cable end dimensioned to engage the outer diameter surface;

a plug hole open to the cable end;

a non-metallic plug retained within the plug hole; the plug dimensioned to insert into the hollow inner conductor and seat against the inner diameter surface; and a seal seated proximate the cable end of the plug dimensioned to seal between the plug and the inner diameter surface.

19. The inner contact of claim 18, wherein the plug has a threaded outer diameter surface dimensioned to thread into a helical corrugation of the hollow inner conductor.

20. An coaxial cable connector inner contact with an interface end and a cable end for a coaxial cable with a hollow inner conductor having an outer diameter surface and an inner diameter surface, comprising:

an inner conductor interface at the interface end;

a spring contact proximate the cable end dimensioned to engage the outer diameter surface;

a plug hole open to the cable end; and a plug retained within the plug hole; the plug dimensioned to insert into the hollow inner conductor and seat against the inner diameter surface;

a seal seated on the plug dimensioned to seal between the plug and the inner diameter surface.

* * * * *